US008336725B2

(12) United States Patent
Ramsey et al.

(10) Patent No.: US 8,336,725 B2
(45) Date of Patent: Dec. 25, 2012

(54) SEALING DEVICE FOR A CONTAINER

(75) Inventors: Christopher Paul Ramsey, Wantage (GB); Alexandre Paris, Leioa (ES)

(73) Assignee: Crown Packaging Technology, Inc., Alsip, IL (US)

( * ) Notice: Subject to any disclaimer, the term of this patent is extended or adjusted under 35 U.S.C. 154(b) by 1086 days.

(21) Appl. No.: 11/503,087

(22) Filed: Aug. 14, 2006

(65) Prior Publication Data

US 2007/0068943 A1 Mar. 29, 2007

(30) Foreign Application Priority Data

Sep. 23, 2005 (EP) ..... 05108820

(51) Int. Cl.

| | |
|---|---|
| ***B65D 51/18*** | (2006.01) |
| ***B65D 17/34*** | (2006.01) |
| ***B65D 39/00*** | (2006.01) |
| ***B65D 43/24*** | (2006.01) |
| ***B65D 43/16*** | (2006.01) |
| ***B65D 41/00*** | (2006.01) |
| ***B65D 43/00*** | (2006.01) |
| ***B65D 47/00*** | (2006.01) |
| ***B65D 51/00*** | (2006.01) |

(52) U.S. Cl. ..... 220/254.3; 220/269; 220/791; 220/831; 220/832; 215/253

(58) Field of Classification Search ..... 220/254.3, 220/269, 791, 831, 832; 215/253
See application file for complete search history.

(56) References Cited

U.S. PATENT DOCUMENTS

| | | | | |
|---|---|---|---|---|
| 3,190,410 | A | 6/1965 | Shaw | |
| 3,250,425 | A | 5/1966 | Stec et al. | |
| 3,262,612 | A | 7/1966 | Tabor | |
| 3,287,053 | A | 11/1966 | Stec et al. | |
| 3,386,613 | A * | 6/1968 | Traynor | 220/269 |
| 3,406,867 | A | 10/1968 | Westphal et al. | |
| 3,447,713 | A | 6/1969 | Stec et al. | |
| 3,450,301 | A | 6/1969 | Stec et al. | |
| 3,520,440 | A | 7/1970 | Kinnavy et al. | |
| 3,622,034 | A | 11/1971 | Lutzker et al. | |

(Continued)

FOREIGN PATENT DOCUMENTS

EP 0088185 8/1983

(Continued)

OTHER PUBLICATIONS

Amtsblatt des Kantons Graubuenden; pub. Sep. 13, 1996,pp. 2746-2747.

(Continued)

*Primary Examiner* — Anthony Stashick
*Assistant Examiner* — Andrew T Kirsch
(74) *Attorney, Agent, or Firm* — Woodcock Washburn LLP

(57) ABSTRACT

A one-piece re-sealable sealing device (210) for use with a container (212), operable between a closed position and an open position in which, when the sealing device (210) is in the closed position it forms a folded shape comprising an upper part (240), a middle part (230) and a base part (220), hinged together. The sealing device (210) further comprises a lever (245,226,224) both for levering the sealing device (210) from the closed position to the open position, and for pivoting the sealing device (210) from the open position to the closed position to re-seal the container.

13 Claims, 9 Drawing Sheets

U.S. PATENT DOCUMENTS

| | | | | | |
|---|---|---|---|---|---|
| 3,705,670 | A | | 12/1972 | Douty | |
| 3,744,662 | A | * | 7/1973 | Zundel | 220/269 |
| 3,788,512 | A | | 1/1974 | Brahler | |
| 3,871,544 | A | | 3/1975 | Peyser | |
| 3,952,911 | A | | 4/1976 | Bozek et al. | |
| 4,054,205 | A | | 10/1977 | Blow, Jr. et al. | |
| 4,098,439 | A | | 7/1978 | Blow, Jr. et al. | |
| 4,122,970 | A | | 10/1978 | Amabilli | |
| 4,127,221 | A | | 11/1978 | Vere | |
| 4,136,797 | A | | 1/1979 | Potts | |
| 4,150,777 | A | | 4/1979 | Cyr | |
| 4,266,688 | A | | 5/1981 | Reid | |
| 4,361,244 | A | | 11/1982 | Walter | |
| 4,369,888 | A | | 1/1983 | Walter | |
| 4,397,400 | A | | 8/1983 | Walter | |
| 4,397,403 | A | * | 8/1983 | Guimarin | 220/269 |
| 4,407,423 | A | * | 10/1983 | Walter | 220/260 |
| 4,431,110 | A | | 2/1984 | Roth | |
| 4,440,310 | A | * | 4/1984 | Heyn | 220/270 |
| 4,462,504 | A | | 7/1984 | Roth et al. | |
| 4,540,611 | A | | 9/1985 | Henderson | |
| 4,576,306 | A | | 3/1986 | Kelsey et al. | |
| 4,681,238 | A | | 7/1987 | Sanchez | |
| 4,746,032 | A | | 5/1988 | Huang | |
| 4,821,912 | A | | 4/1989 | Wells | |
| 4,915,290 | A | | 4/1990 | Robichaud et al. | |
| 4,930,654 | A | | 6/1990 | Thibeault et al. | |
| 4,951,835 | A | | 8/1990 | DeMars et al. | |
| 5,085,338 | A | | 2/1992 | Inagaki | |
| 5,148,935 | A | | 9/1992 | Lyon | |
| 5,199,591 | A | | 4/1993 | Thibeault et al. | |
| 5,199,618 | A | | 4/1993 | Reil et al. | |
| 5,242,073 | A | | 9/1993 | Willis et al. | |
| 5,335,808 | A | | 8/1994 | Lee | |
| 5,351,853 | A | | 10/1994 | Shock | |
| 5,622,273 | A | | 4/1997 | Kelly | |
| 5,692,633 | A | | 12/1997 | Gordon | |
| 5,711,447 | A | | 1/1998 | Plester | |
| 5,813,561 | A | | 9/1998 | Chang et al. | |
| 5,829,610 | A | | 11/1998 | Rohr et al. | |
| 5,947,317 | A | | 9/1999 | Hall | |
| 6,065,634 | A | | 5/2000 | Brifcani et al. | |
| 6,105,806 | A | | 8/2000 | Stasiuk | |
| 6,581,264 | B2 | | 6/2003 | Ohori et al. | |
| 6,588,617 | B1 | | 7/2003 | Majcen et al. | |
| 6,763,963 | B1 | | 7/2004 | Martin | |
| 7,152,766 | B1 | | 12/2006 | Walsh et al. | |
| 7,168,586 | B2 | | 1/2007 | Jeon | |
| 7,198,168 | B2 | | 4/2007 | Mizuma | |
| 2002/0050493 | A1 | | 5/2002 | Ball et al. | |
| 2003/0062370 | A1 | | 4/2003 | Ball et al. | |
| 2003/0178433 | A1 | | 9/2003 | Adams | |
| 2005/0051553 | A1 | | 3/2005 | Li et al. | |
| 2005/0115977 | A1 | | 6/2005 | Dibdin et al. | |
| 2005/0150889 | A1 | | 7/2005 | Perra | |
| 2005/0173453 | A1 | | 8/2005 | Azodi | |
| 2006/0163253 | A1 | | 7/2006 | Steadman | |
| 2007/0068943 | A1 | | 3/2007 | Ramsey | |
| 2007/0145055 | A1 | | 6/2007 | Gardiner | |
| 2007/0164026 | A1 | | 7/2007 | Morrissey | |
| 2007/0215620 | A1 | | 9/2007 | Kasper | |
| 2007/0262079 | A1 | | 11/2007 | Paris | |
| 2008/0053997 | A1 | | 3/2008 | Perra | |
| 2008/0110887 | A1 | | 5/2008 | Ramsey | |
| 2008/0314904 | A1 | | 12/2008 | Perra | |
| 2009/0173737 | A1 | | 7/2009 | Ramsey | |
| 2009/0179033 | A1 | | 7/2009 | Ramsey | |

FOREIGN PATENT DOCUMENTS

| | | | |
|---|---|---|---|
| EP | 0305598 | A1 | 3/1989 |
| EP | 0828663 | B1 | 12/1999 |
| EP | 1767464 | | 3/2007 |
| FR | 1434827 | A | 6/1966 |
| GB | 2154561 | A | 9/1985 |
| GB | 2320008 | | 6/1998 |
| JP | 61-48128 | | 5/1994 |
| JP | 2003-054549 | | 2/2003 |
| JP | 2003-112735 | | 4/2003 |
| KR | 2000-17742 | | 4/2000 |
| WO | WO 91/10600 | | 7/1991 |
| WO | WO 95/04709 | | 2/1995 |
| WO | WO 96/09968 | | 4/1996 |
| WO | WO 98/36987 | | 8/1998 |
| WO | WO 01/28875 | | 4/2001 |
| WO | WO 02/00512 | | 1/2002 |
| WO | WO 03/062084 | | 1/2003 |
| WO | WO 2007/039367 | | 4/2007 |
| WO | WO 2007/128810 | | 11/2007 |
| WO | WO 2008/068169 | | 6/2008 |
| WO | WO 2008/054636 | | 7/2008 |
| WO | WO 2009/062004 | | 5/2009 |

OTHER PUBLICATIONS

U.S. Appl. No. 12/470,909, filed May 22, 2009, Ramsey.

U.S. Appl. No. 11/747,049: Non-Final Rejection, Sep. 15, 2009.

English Translation of Abstract of JP 2003-112735, published on Apr. 18, 2003.

English Translation of Abstract of JP 2003-054549, published on Feb. 26, 2003.

English Translation of Abstract of JP 61-48128, published on May 27, 1994.

U.S. Appl. No. 11/591,041: Requirement for Restriction/Election, Sep. 2, 2009.

U.S. Appl. No. 11/591,041: Amendment/Request for Reconsideration After Non-Final Office Action, Sep. 29, 2009.

U.S. Appl. No. 11/591,041: Non-Final Rejection, Dec. 23, 2009.

U.S. Appl. No. 12/447,576, filed Apr. 28, 2009.

U.S. Appl. No. 11/591,041: Non-Final Rejection dated Aug. 16, 2011, 14 pages.

U.S. Appl. No. 11/591,041: Final Rejection dated Jan. 20, 2012, 6 pages.

* cited by examiner

PRIOR ART

SEALING DEVICE FOR A CONTAINER

TECHNICAL FIELD

The present invention relates to a sealing device. In particular it relates to a re-sealable one-piece hinged sealing device for use with a closure for a beverage container.

Beverage containers typically comprise a metal can body which is closed by means of an "easy open can end". Such ends are generally opened by raising a metal tab, the nose of which presses onto a scored panel, which is thus forced open to provide a pouring aperture. Such easy open ends are, however, not re-sealable.

BACKGROUND ART

One way of re-sealably closing such cans is known from pages 2746-2747 of the Amtsblatt des Kantons Graubünden, published on 13 Sep. 1996. This publication describes a resealable closure which comprises a lid for permanently fixing to a can body, and a removable sealing device for sealing a pouring aperture in a panel of the lid. The sealing device comprises two parts (called "leaves"), which are joined by an integral hinge. The sealing component is connected to a can end panel by a further hinge, the can end and sealing device together forming the closure.

Although, in theory this closure is re-sealable, in practice sealing is extremely difficult to achieve due to the interference or push fit between the various parts of the sealing component. Further problems with this closure are that there is no clear device for indicating tampering, the sealing device requires a specially formed can end panel, and there is a risk of "missiling" of the sealing component due to the inadequate way with which it is fixed to the rest of the closure.

Another way of re-sealably closing a beverage can is known from U.S. Pat. No. 4,369,888. This patent describes a one-piece closure with two integral hinges. However, although opening of the closure is aided by the ability to lever one part relative to another, it is extremely difficult to re-seal the closure again due to the interference fit between the various parts. In addition, the closure can get in the way of the aperture when a consumer attempts to drink from the can.

Since this type of re-sealable closure typically uses sealing components which are made from plastic materials, it is preferable to be able to remove the closure/sealing components completely before re-cycling the metal can. However, this requirement may cause problems since if the sealing device is relatively simple to remove from the can then there is a risk of missiling before the closure has been opened and vice-versa.

DISCLOSURE OF THE INVENTION

According to the present invention, there is provided a one-piece sealing device for use with a container end, operable between a closed position and an open position in which, when the sealing device is folded into a closed position in which the folded sealing device comprises an upper part, a middle part and a base part, hinged together, the sealing device further comprising means for levering the sealing device from the closed position to the open position, characterised in that: the sealing device is recloseable by levering the sealing device from the open position to the closed position; and the leverage means comprises a beak and a complementary pocket and fulcrum, the beak being provided on the upper part and the pocket and fulcrum on the base, or vice versa.

The sealing device of the invention is easily re-sealable and yet remains fixed to the can when in the closed position. An advantage of this arrangement is that it is possible to provide a tight seal between the sealing device and the container and yet still be able to open and close the sealing device with relative ease.

The upper part of the sealing device may be substantially planar and have a lower surface which, when the sealing device is in the closed position, lies adjacent the middle part so that the beak has an upper surface which lies at a level lower than the upper surface of the upper part.

Preferably, the sealing device further comprises a projection which is hingedly connected to the upper part, and a strap for limiting movement between the projection and the upper part. An advantage of this arrangement is that of tamper evidence in that the end will be loose and not rigidly connected to the rest of the sealing device.

In one embodiment, the upper part of the sealing device further comprises an element for applying sealing pressure to the middle part, in which the middle part has means for transferring this pressure onto the base part and the base part has means for transferring this pressure onto an edge of the aperture to fix the sealing device to the container end.

The sealing device ideally further comprises means for holding it in the open position, thus allowing full access to the drinking channel.

According to another aspect of the present invention, there is provided a one-piece re-sealable sealing device for use with a container end, operable between a closed position and an open position in which, when the sealing device is in the closed position it is folded into a shape comprising an upper part, a middle part and a base part, hinged together, the sealing device further comprising a projection which is hingedly connected to the upper part, characterised in that: the sealing device further comprises means provided between the projection and the upper part for limiting the relative hinge movement between the projection and the upper part.

This arrangement also is easy to open and reclose but provides a tight seal between the sealing device and the container.

According to a further aspect of the present invention, there is provided a one-piece re-sealable sealing device for fixing to an aperture of a container, operable between a closed position and an open position in which, when the sealing device is in the closed position it is folded into a shape which comprises an upper part, a middle part and a base part, hinged together, characterised in that: the upper part comprises an element for applying sealing pressure to the middle part, in which the middle part has means for transferring this pressure onto the base part and the base part has means for transferring this pressure onto a rim (214) of the aperture to adequately fix the sealing device to the container.

An advantage of this arrangement is that the maximum pressure is only provided by the sealing device when the sealing device is in the fully closed position. Further, during opening this maximum pressure may be reduced incrementally to provide relatively easy opening.

A final embodiment of the invention comprises a one-piece re-sealable sealing device for use with a container end, operable between a closed position and an open position in which when the sealing device is in the closed position it takes a folded shape comprising an upper part, a middle part and a base part, hinged together, the sealing device further comprising leverage means for levering the sealing device from the closed position to the open position, characterised in that: the sealing device further comprises means for holding the sealing device in the open position.

An advantage of this arrangement is that the sealing device does not impede drinking straight from the container.

BRIEF DESCRIPTION OF THE DRAWINGS

The present invention and its advantages will be better understood by referring, by way of example, to the following detailed description and the attached Figures, in which

FIG. 1 is a plan view of a known sealing device,

FIG. 2 is a side-section of the sealing device of FIG. 1,

FIG. 3 is a cross-section through another known sealing device in the closed position.

MODE(S) FOR CARRYING OUT THE INVENTION

Figure 1:
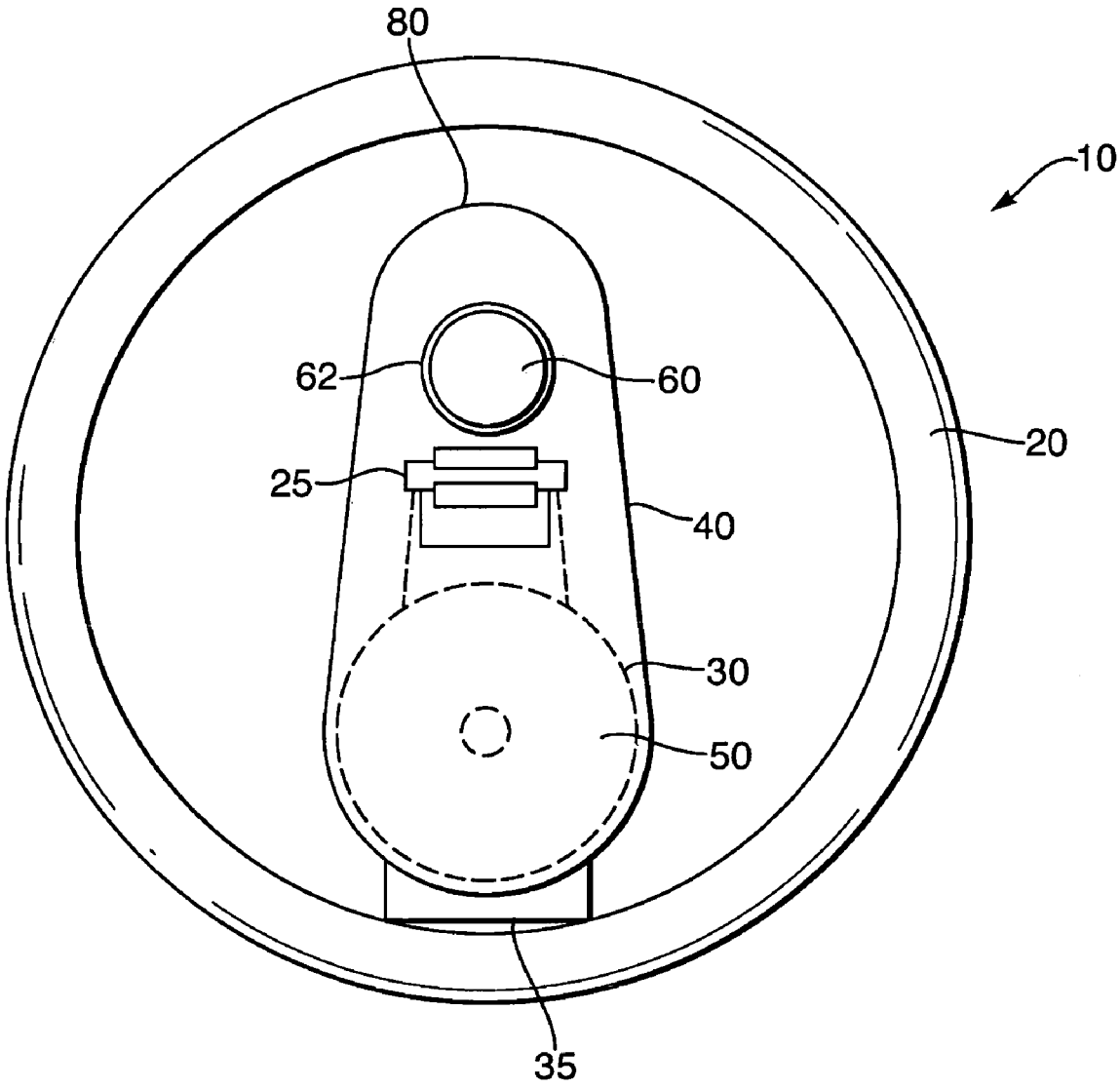
FIGS. 1 to 3 are prior art.
Figure 2:
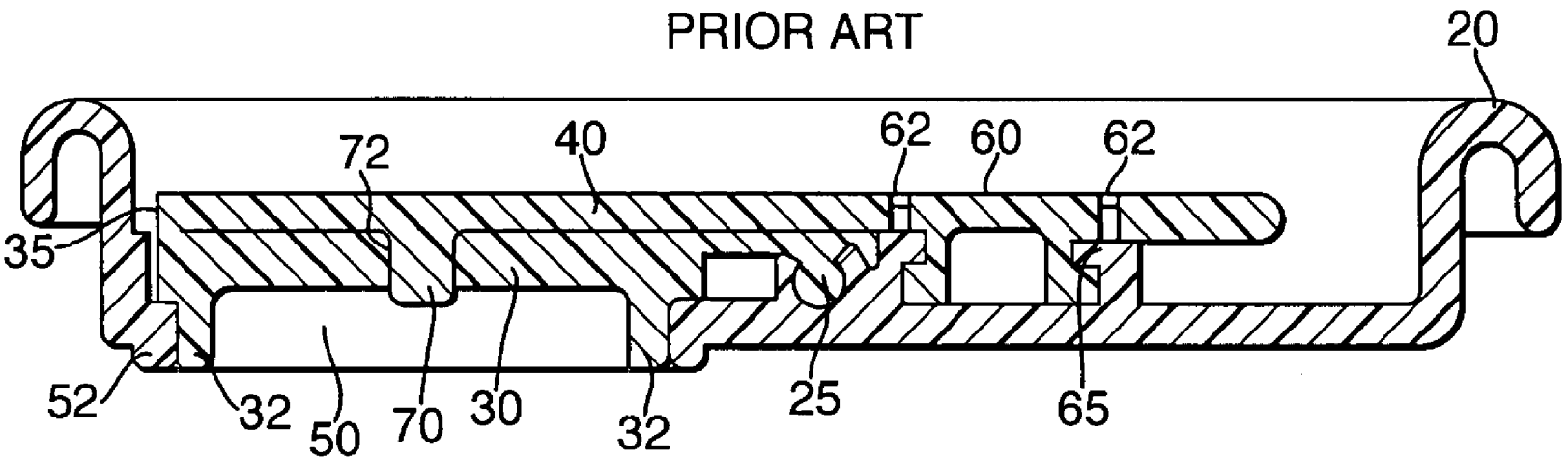

FIGS. 1 and 2 show a sealing device according to the disclosure in the Amtsblatt des Kantons Graubünden, as discussed above. The base or lower part 20 of the sealing device 10 is in this case a specially formed end panel for a drink can. The sealing device further comprises a middle part 30 which acts to plug the aperture 50 in the can end 20. The middle part 30 is connected to the can end 20 by means of a hinge 25. A top part 40 overlies and is connected to the middle part 30 by an integral hinge 35. The top part is opened by means of inserting a tool or finger under the end 80 of upper part 40 and lifting as will be described in more detail below. Opening of the sealing device 10 is evidenced by tamper evidence means 60,62.

It can be seen from FIG. 2 that the base part 20, which forms one piece of the two-piece sealing device, is a specially formed can end panel which includes hinge means 25 and tamper evidence means 65 which are integral with its upper surface. This is in contrast to centre panels of conventional easy open beverage can ends, which are relatively flat. Accordingly, a problem with such sealing devices as shown in FIGS. 1 and 2 is that they are relatively bulky when stacked together and more costly to manufacture.

The middle part 30 and upper part 40 of the sealing device are formed as one-piece and are connected by an integral hinge 35. The middle part 30 has a sealing annulus 32 which projects downwardly towards the can and has an interference fit with the circumference 52 of the aperture 50 in base part 20. Together with this sealing annulus 32, the middle part 30 seals the aperture 50. A hole 72 is provided in the middle part 30 for venting. This is sealed in turn by plug 70 which projects downwardly from the underside of upper part 40.

Figure 3:
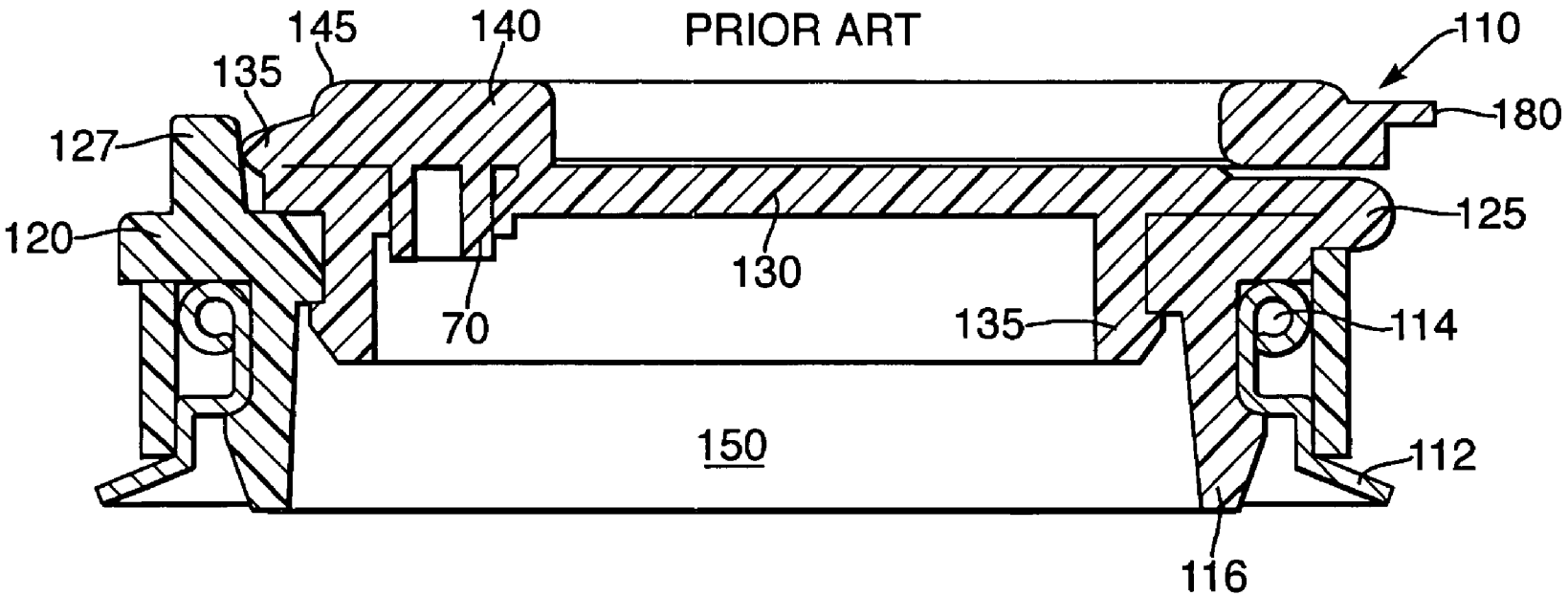

FIG. 3 shows a cross-section through another known closure as described in U.S. Pat. No. 4,369,888. This closure is manufactured as a one-piece sealing device 110 but is able to be folded due to two integral hinges 125,135.

This type of closure has been manufactured for use with cans which are necked in at the upper end of the can body side wall so as to form a bottle shape. The aperture 150 at the upper end of the neck is then closed by this closure 110.

The base part 120 of the folded sealing device sits on top of the rim 114 of the container 112 and is retained in the neck by means of well known snap beads 116 which extend underneath the shoulder of the container 112. The base part 120 has an opening or pouring aperture to allow the contents of the container 112 to be discharged.

The middle part 130 is hinged to the base part 120 by means of hinge 125, and extends across the pouring aperture so as to seal it.

The middle part 130 is held in place on the base part 120 by means of snap beads 135. A vent hole is provided through the middle part 130 and is sealed by a plug 170 depending from the upper part 140.

The upper part 140 of the sealing device 110 is hinged to the middle part 130 by hinge 135. Upper part 140 lies across the middle part 130 and has a projection 180, which is lifted for venting and opening of the container. The middle part 130 is levered up away from the base part 120 by pressing the end 145 of the upper part 140 against fulcrum 127.

To re-seal the sealing device 110 the reverse is performed so that the upper part 140 is pressed against the middle part 130 and then the two parts 130,140 are pressed down such that bead 135 snaps under the corresponding edge of the base part 120.

This re-sealing action is extremely difficult to achieve for infirm and young people and accordingly the sealing device is no longer manufactured.

To alleviate the problem of re-sealing it would in theory be possible to decrease the interference fit between the middle 130 and base 120 parts. However, if this is done then there is a risk that the sealing device will not effectively seal the can and further that if the pressure within the can were to rise, due to, for instance, a temperature rise, the sealing device may open and thus ruin the contents of the can.

One version of this sealing device 110 has a tamper evidence feature, in which projection 180 is connected by a hinge to the upper part 140. Frangible bridges or a frangible score-line connect the sides of the projection 180 with the sides of the upper part 140. When the sealing device 110 is first opened the frangible bridges or score-line are broken leaving the projection 180 only connected to the upper part 140 by the hinge. As a result, the projection 180 is insubstantially held to the upper part 140 thus making opening of the sealing device more difficult. Instead of being to able to pull back on the projection 180 of the upper part 140 in the manner used with typical ring-pull sealing devices, the projection 180 has to be grasped and pulled upwards. Since the projection 180 is rather small this causes problems.

The connection between the upper part 140 and projection 180 is easily broken so that projection 180 may be lost. This clearly increases the difficulty of opening the sealing device 110.

FIGS. 1 to 3 show prior art sealing devices. A sealing device according to the invention is now described with reference to FIGS. 4 to 9.

Figure 4:
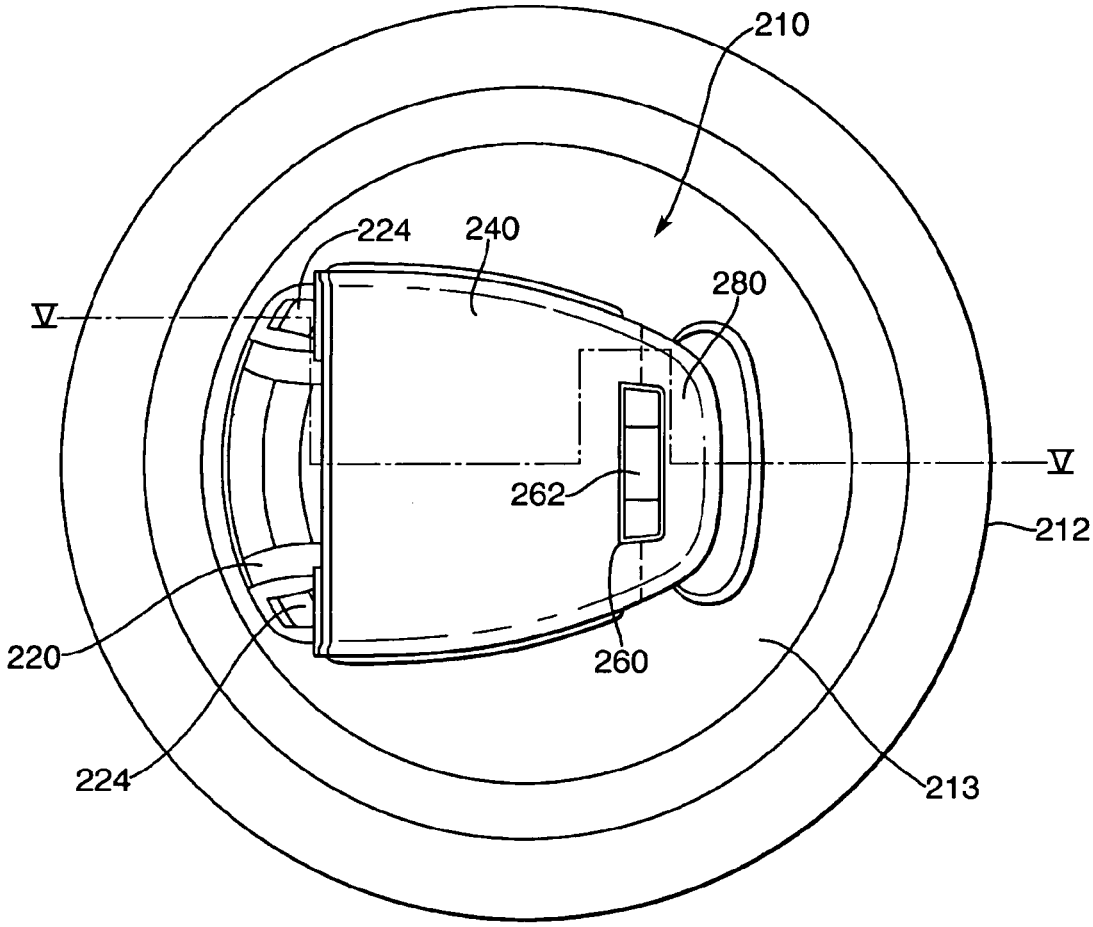
FIG. 4 is a plan view of the sealing device of the invention in the closed position.

FIG. 4 shows a plan view of a can with a can end having a sealing device 210 according to the invention. The can body 212 has been necked at its upper end and can end 213 joined to the can body by a double seam.

Figure 5:
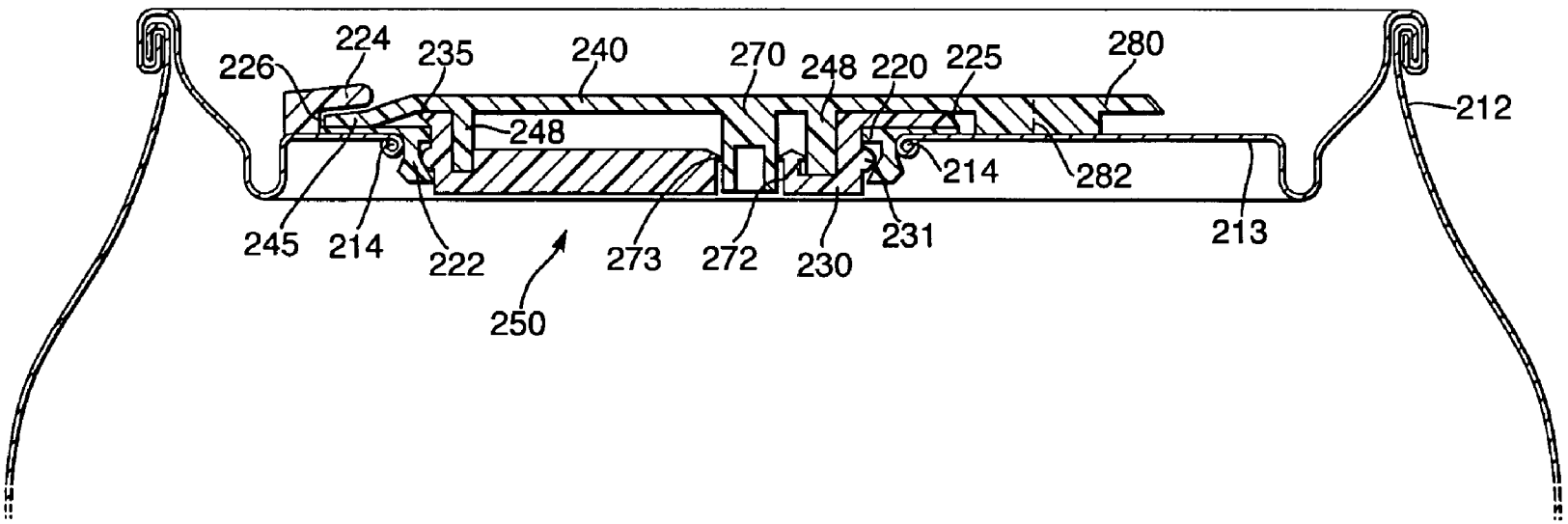
FIGS. 5 to 8 show a sequence of cross-sections of the sealing device of the invention, from a closed position to a fully open position.

A section of the sealing device 210 along line V-V of FIG. 4 is shown in FIG. 5. Sealing device 210 comprises a base part 220, a middle part 230 and an upper part 240. The sealing device is manufactured in a single piece and folded into three layers by means of two integral hinges 225, 235.

The base part 220 is fitted inside an aperture 250 of the can end 213. In the example shown, the circumferential edge of the aperture has been curled into a rolled edge 214. This aids the strength of the can end and the fixing of the sealing device 210 into the can end panel 213 and allows a mechanical seal to be made between the end and the closure.

The base part 220 is mounted on top of the can end 213 and has an annulus 222 which depends downwardly and through the aperture 250. This annulus 222 may include a bead on its outer radial surface for clipping onto the curled edge 214 of the aperture 250 so as to hold the base part 220 to the end panel 213.

Alternatively, this annulus 222 could be mechanically deformed during the insertion into aperture 250 to fix it to the can end 213. Another alternative (also not shown) is that the base part 220 could be welded to a flange-like part which is provided underneath the can end 213.

At one end of the base part 220 two fulcra 224 are provided. Their purpose is explained in more detail below.

The middle part 230 is integrally connected to the base part 220 by means of hinge 225. The middle part 230 has a vent hole 272 provided therein. Further, it may be seen that the majority of the middle part 230 lies below the level of the can end 213. This is so that the overall thickness of the sealing device 210 is relatively thin which is advantageous for seaming and stacking. A bead 231 extends circumferentially about the outer radial surface of the portion of the middle part 230, which lies below the level of the can end panel 213. This bead 231 snaps into engagement with a corresponding detent on the inner radial surface of base part 220 so as to hold the two parts 220,230 together. Using thinner material than as shown in the figures for the wall provides sufficient flexibility to minimise and/or optimise closing forces.

The upper part 240 is connected to the middle part 230 by means of hinge 235. However, this hinge does not extend across the entire length between the two parts 230,240 because upper part 240 has two so-called "beaks" 245 which extend beyond and on either side of the hinge 235. In the closed position, as is seen in FIG. 5, each beak 245 rests in a pocket 226 formed between its corresponding fulcrum 224 and the base part 220.

A plug 270 depends downwardly from the upper part 240 so as to seal the vent hole 272 in the middle part 230. A bead 273 on the inner radial surface of the vent hole 272 provides an interference fit between the plug 270 and the hole 272. A projection in the form of a continuous annulus 248 depends downwardly from the underside of the upper part 240. This annulus 248 co-operates with a corresponding circular slot formed in the upper surface of middle part 230.

When the sealing device is in the fully closed position, as shown in FIG. 5, the annulus 248, which is dimensioned so as to have an outer radius which is slightly larger than the outer radius of the slot, applies sealing pressure to the middle part 230. In the example shown this may also push the beaded wall 231 on the outer radial surface of the middle part 230 radially outwardly. Closing forces are reduced by making the wall 231 of thin, flexible material. This in turn pushes the free edge of the annulus 222 of the base part 220 radially outwardly under the rim 214 of the aperture 250 in the top plate 213. This sequential pressure from the top plate 240 to the middle part 230 to the base plate 220 to the aperture 250 ensures that the sealing device 210 is firmly fixed to the can end 213 when in the closed position. This reduces the risk of missiling of the sealing device due to increased pressure within the container/can.

Although the feature referenced 248 has been described as a continuous annulus it will of course be evident that other forms could equally be employed such as a discontinuous annulus or even separate teeth-like projections.

Turning now to the tamper evident feature it may be seen in FIG. 5 that a score-line 282 is provided on the side of the upper part 240 adjacent to the projection 280.

Figure 6:
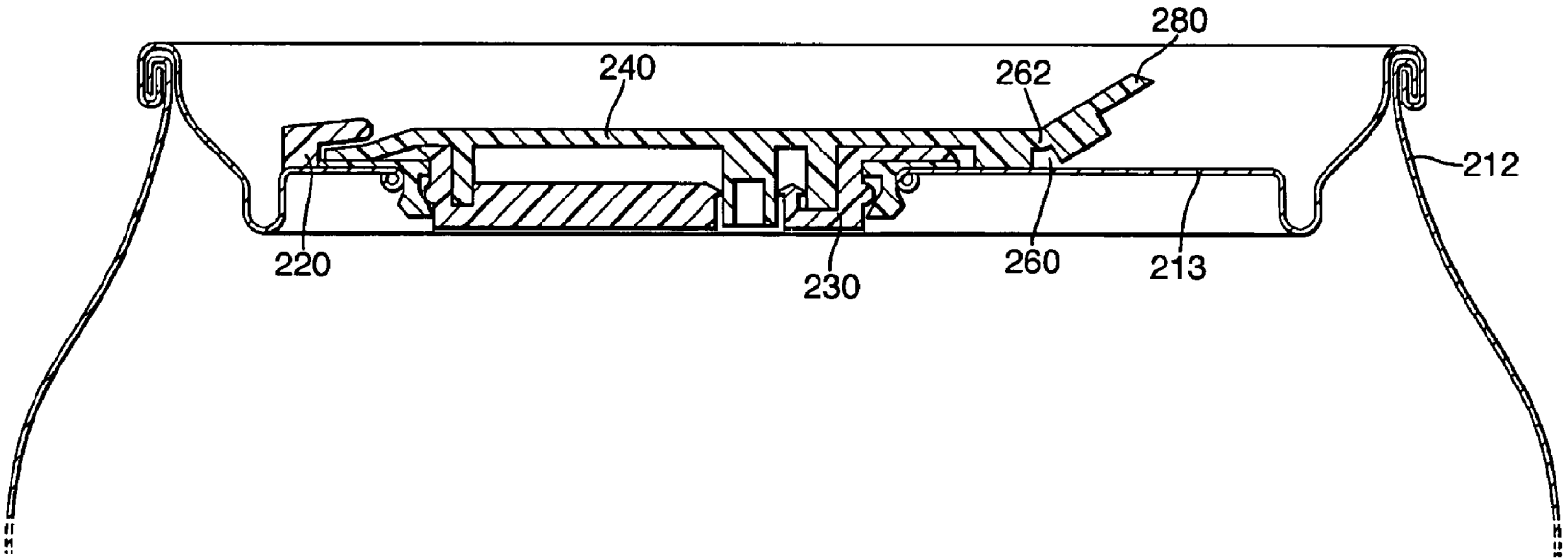

With reference to FIG. 6, to open the sealing device 210, a tool or finger in inserted under projection 280, which is then raised to break the score-line 282 breaks such that the projection 280 bends away from the upper part 240. Strap 262 underneath the upper part 240 limits the amount which the projection 280 can be bent, an angle of 30 degrees being ideal. This ensures that the projection 280 is still connected to the upper part 240 in a manner that continued lifting action of the projection will lift the upper part 240 away from the middle part 230.

Figure 7:
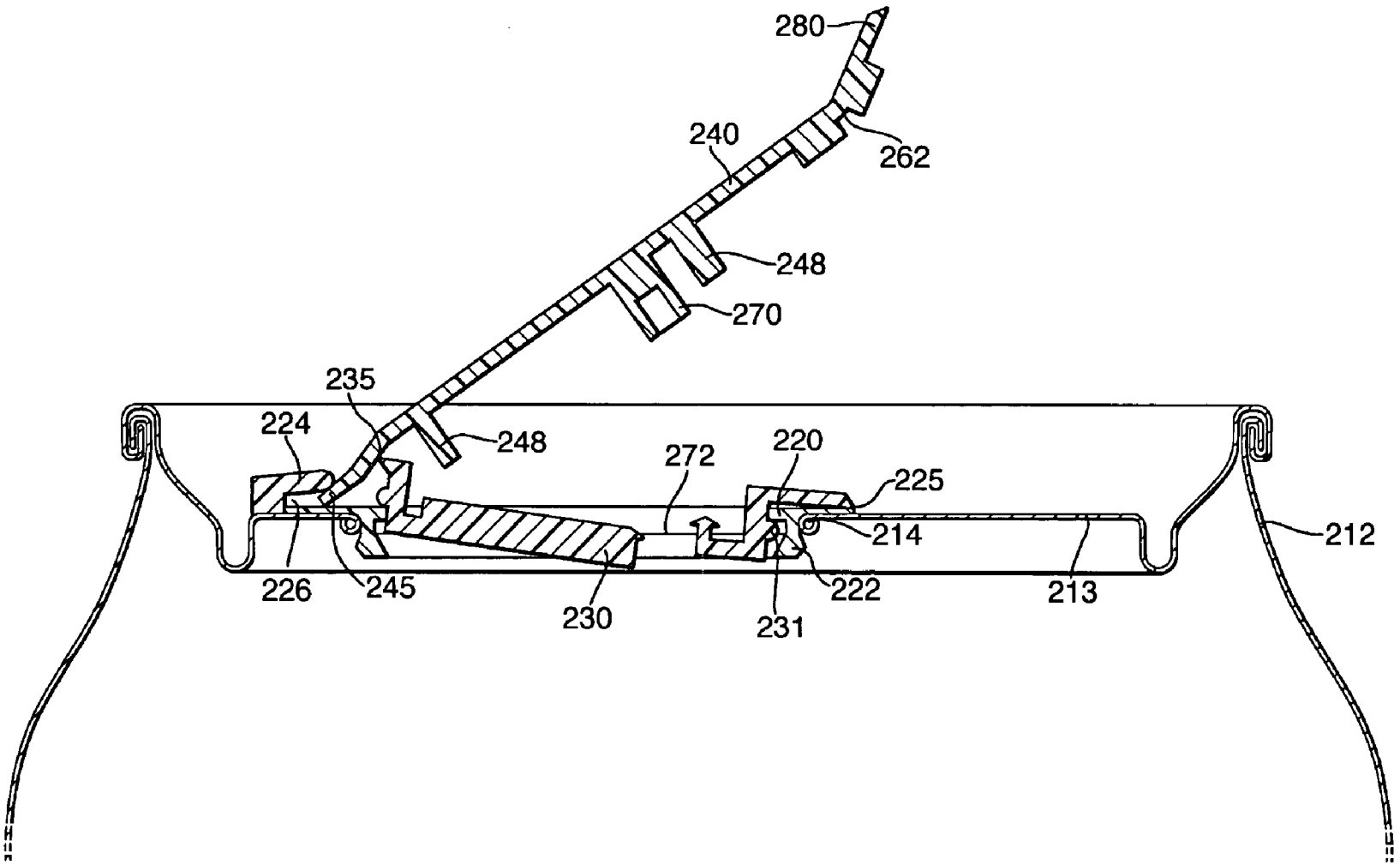

FIG. 7 shows the sealing device after continued lifting of projection 280 has taken place. Venting of the container occurs as the vent plug 270 lifts out of the vent hole 272. The annulus 248 then lifts away from and out of the corresponding slot in the middle part 230. Accordingly, the radially outward pressure which had previously been applied by this annulus 248 to the sealing of the middle part 230 to the base part 220 and thus to the can aperture 250 is relieved.

The pivoting action achieved by the beaks 245, the fulcra 224 and the pocket 226 levers the middle part away from the base part 220 by means of pulling the end 280 towards the left hand side, as shown in the figures.

Figure 8:
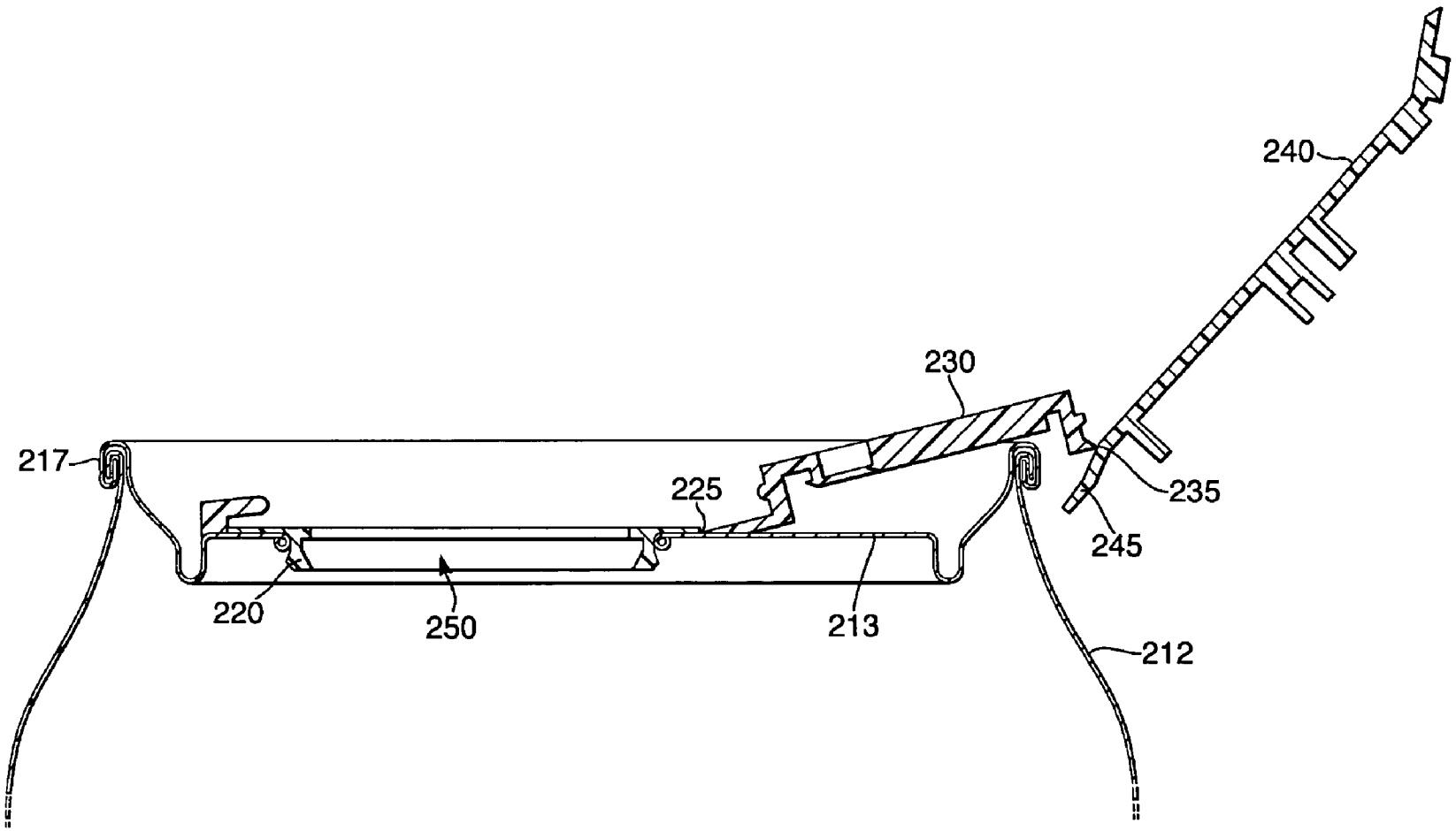

Once the middle part 230 has been completely disengaged with the base part 220, the upper and middle parts 230,240 may be angled away from the base part 220 and aperture 250 by hinge 225 as shown in FIG. 8. This means that the upper and middle parts 230,240 of the sealing device can be moved out of the way so as to provide unimpeded access to the aperture 250. Accordingly, it is possible to drink straight from the can without being obstructed by the sealing device. By having two fulcra 224 which are spaced apart, rather than a single fulcrum, a drinking channel is provided between the fulcra.

FIG. 8 further shows how the upper part 240 may be held in place by resting the beaks 245 underneath the curl 217 of the can 212.

Figure 9:
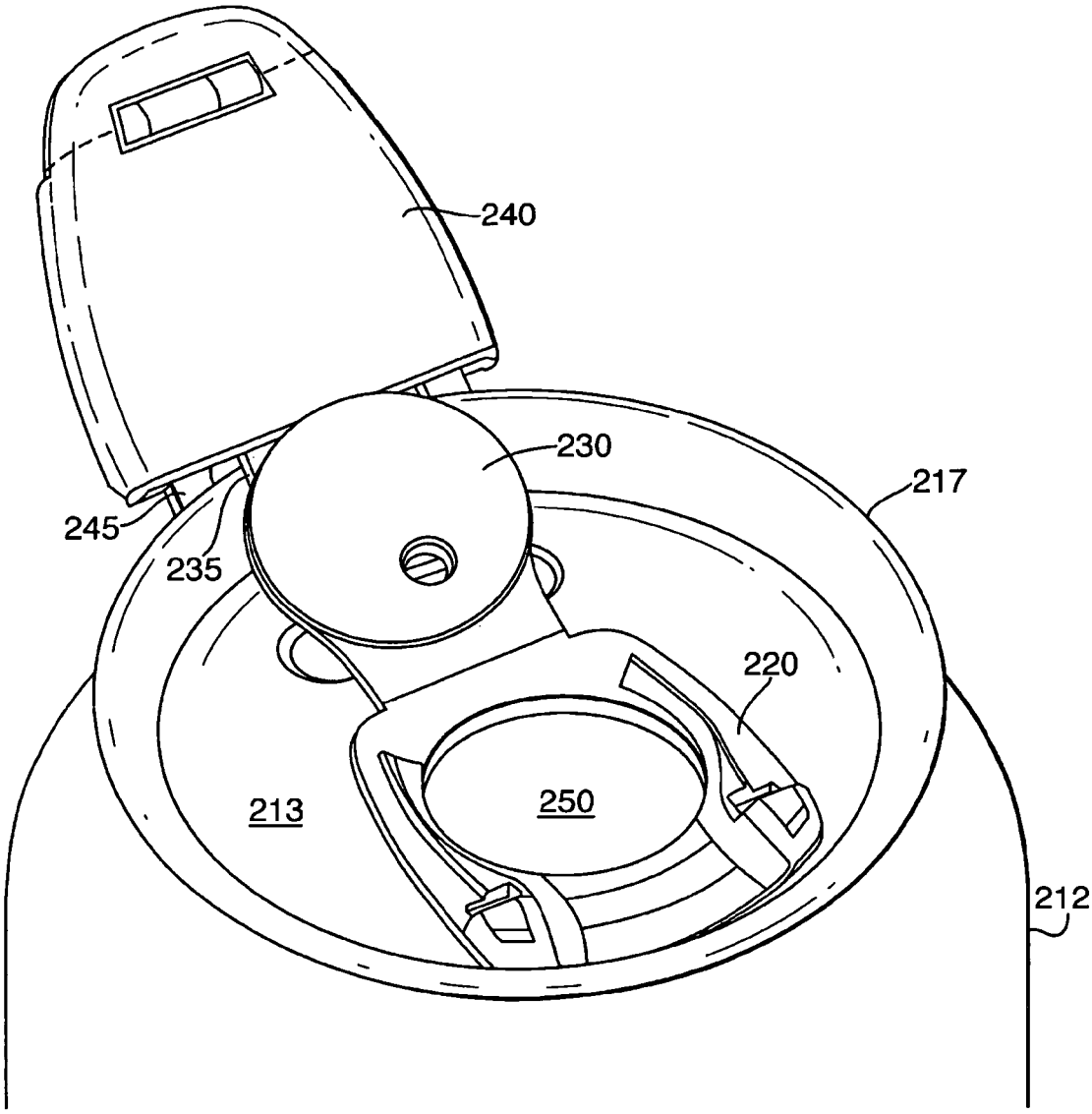
FIG. 9 shows a perspective view of the new sealing device in the fully open position.

FIG. 9 shows a perspective view of the sealing device in the fully opened position with an associated container.

To re-seal the sealing device the upper part is un-hooked from the rim 217 of the can 212 and the sealing device returned to the position shown in FIG. 7. Then the middle part is levered back into sealing engagement with the base part 220 by means of the beaks 245, pocket 226 and fulcra 224.

Since the pressure applied by annulus 248 against middle part 230 is only applied when the sealing device is fully closed it is relatively easy to force the middle part 230 into correct and sealing engagement with the base part 220. However, once the upper part 240 has then been pushed completely down onto the middle part 230 the annulus 248 provides the sealing pressure to seal the base part 220 to the can aperture 250 as described above.

Evidence that the sealing device has been opened, even if it has been re-sealed, is apparent from the projection 280 which will no longer be rigidly connected to the upper part 240 but only connected by means of the strap 262.

Although the invention has been described above with reference to a can 212, it may of course be used with other containers.

What is claimed is:

1. A one-piece sealing device configured for use with a container end operable between a closed position and an open position, the sealing device comprising:

an upper part, a middle part coupled to the upper part by a first hinged, and a base part coupled to the middle part by a second hinge, the upper part further including a lever configured for levering the sealing device from the closed position to the open position, the sealing device configured to be recloseable by levering the sealing device from the open position to the closed position;

wherein the lever includes a beak that extends from the upper part and radially beyond the first hinge when the clouser is in the closed position, and the base part includes a complementary pocket and fulcrum that extends partially across the base part such that the pocket is defined underneath the fulcrum, and the fulcrum and part are configured to releasably receive and hold the beak in the pocket beneath the fulcrum.

2. The sealing device as defined in claim 1, in which the upper part is substantially planar and has a lower surface which, when the sealing device is in the closed position, lies adjacent the middle part and in which the beak has an upper surface which lies at a level lower than the upper surface of the upper part.

3. The sealing device as defined in claim 1 configured to be fixed to an aperture of a container end, in which the upper part further comprises an element configured to apply sealing pressure to the middle part, in which the middle part is configured to transfer this pressure onto the base part and the base part is configured to transfer this pressure onto an edge of the aperture to fix the sealing device to the container end.

4. The sealing device as defined in claim 1, further comprising means configured to hold the sealing device in the open position.

5. A one-piece re-sealable sealing device configured for fixing to an aperture of a container, the sealing device being operable between a closed position and an open position in which, when the sealing device is in the closed position it is folded into a shape which comprises an upper part, a middle part coupled to the upper part by a first hinge, and a base part coupled to the middle part by a second hinged, the upper part including an element configured to apply sealing pressure to the middle part, in which the middle part is configured to transfer this pressure onto the base part the base part is configured to transfer this pressure onto a rim of the aperture to adequately fix the sealing device to the container; the upper part further including a lever configured for levering the sealing device from the closed position to the open position, the sealing device being recloseable by levering the sealing device from the open position to the closed position; the lever including a beak that extends from the upper part and radially beyond the first hinge when the closure is in the closed position; and the base part including a complementary pocket and a fulcrum, the fulcrum extending partially across the base part such that the pocket is defined underneath the fulcrum, and the fulcrum and pocket are configured to releasably receive and hold the beak in the pocket beneath the fulcrum.

6. A The sealing device as defined in claim 5, further comprising means for holding the sealing device in the open position.

7. The one-piece sealing device as defined in claim 1 in combination with a container end wherein the leverage means configured to cooperate with the container end to hold the sealing device in the open position.

8. The one-piece re-sealable sealing device as defined in claim 5 in combination with a container end including means configured to cooperate with the container end to hold the re-sealable sealing device in the open position.

9. The sealing device as defined in claim 2 for fixing to an aperture of a container end, in which the upper part further comprises an element configured to apply sealing pressure to the middle part, in which the middle part configured to transfer this pressure onto the base part and the base part is configured to transfer this pressure onto an edge of the aperture to fix the sealing device to the container end.

10. The sealing device as defined in claim 2, further comprising means for holding the sealing device in the open position.

11. The sealing device as defined in claim 3, further comprising means for holding the sealing device in the open position.

12. A reclosable can end comprising:

a metal can end comprising a peripheral wall and a center panel, the center panel having an aperture therethrough; and a closure configured to be operable between an open position and a closed position, the closure comprising:

a base plate including an annulus configured to form a seal with an edge of the can end aperture, and a fulcrum that extends partially across the base plate such that a pocket is defined underneath the fulcrum;

a middle plate connected to the base plate by a first hinge; and a top plate connected to the middle plate by a second hinge, the top plate including a lever and a beak that extends from the top plate and radially beyond the second hinge when the closure is in the closed position, wherein (i) the beak is configured to engage the pocket, and (ii) the pocket is configured to receive and hold the beak underneath the fulcrum when the closure is in the closed position.

13. A reclosable can end comprising:

a metal can end comprising a peripheral wall and a center panel, the center panel having an aperture therethrough; and a closure configured to be operable between an open position and a closed position, the closure comprising:

a top plate, a middle plate connected to the top plate by a first hinge, and a base plate connected to the middle plate by a second hinge;

the top plate comprising a first lever configured to apply sealing pressure to the middle plate, the first lever including a beak that extends from the top plate and radially beyond the first hinge when the closure is in the closed position;

the middle plate comprising a second lever configured to apply sealing pressure to the base plate; and the base plate configured to transfer pressure to a rim of the aperture securing the sealing device to the can end, the base plate including a fulcrum that extends partially across the base plate to form a pocket, wherein the pocket is defined underneath the fulcrum and is configured to receive and hold the beak when the closure is in the closed position.

* * * * *